US005833478A

United States Patent [19]

Tseng et al.

[11] Patent Number: 5,833,478

[45] Date of Patent: Nov. 10, 1998

[54] STACKED HORIZONTAL SIMM CONNECTOR ASSEMBLY

[75] Inventors: Gwou-Jong Tseng; Lie-Ming Poi, both of Tu-Chen, Taiwan

[73] Assignee: Hon Hai Precision Ind. Co., Ltd., Taiwan

[21] Appl. No.: 393,704

[22] Filed: Feb. 24, 1995

[51] Int. Cl.[6] ..... H01R 13/62

[52] U.S. Cl. ..... 439/326

[58] Field of Search ..... 439/326, 541.5, 439/64, 159

[56] References Cited

U.S. PATENT DOCUMENTS 4,747,790 5/1988 Masuda et al. ..... 439/326

5,176,523 1/1993 Lai ..... 439/64

5,415,573 5/1995 Chen et al. ..... 439/326

*Primary Examiner*—P. Austin Bradley

*Assistant Examiner*—Yong Kim

[57] ABSTRACT

Mini SIMM socket connector assembly is comprised of two stacked Mini SIMM socket connector wherein each Mini SIMM socket connector includes a housing having a central slot with a plurality of contacts aside for receiving a module therein whereby the module can be inserted into the housing in a first position and successively rotated to be retained in a second position. The positioning arrangement of the upper connector with regard to the lower connector is designed to leave sufficient space thereabout for not resulting in any interference with the module of the lower connector during insertion of the module of the lower connector into the housing of the lower connector.

5 Claims, 13 Drawing Sheets

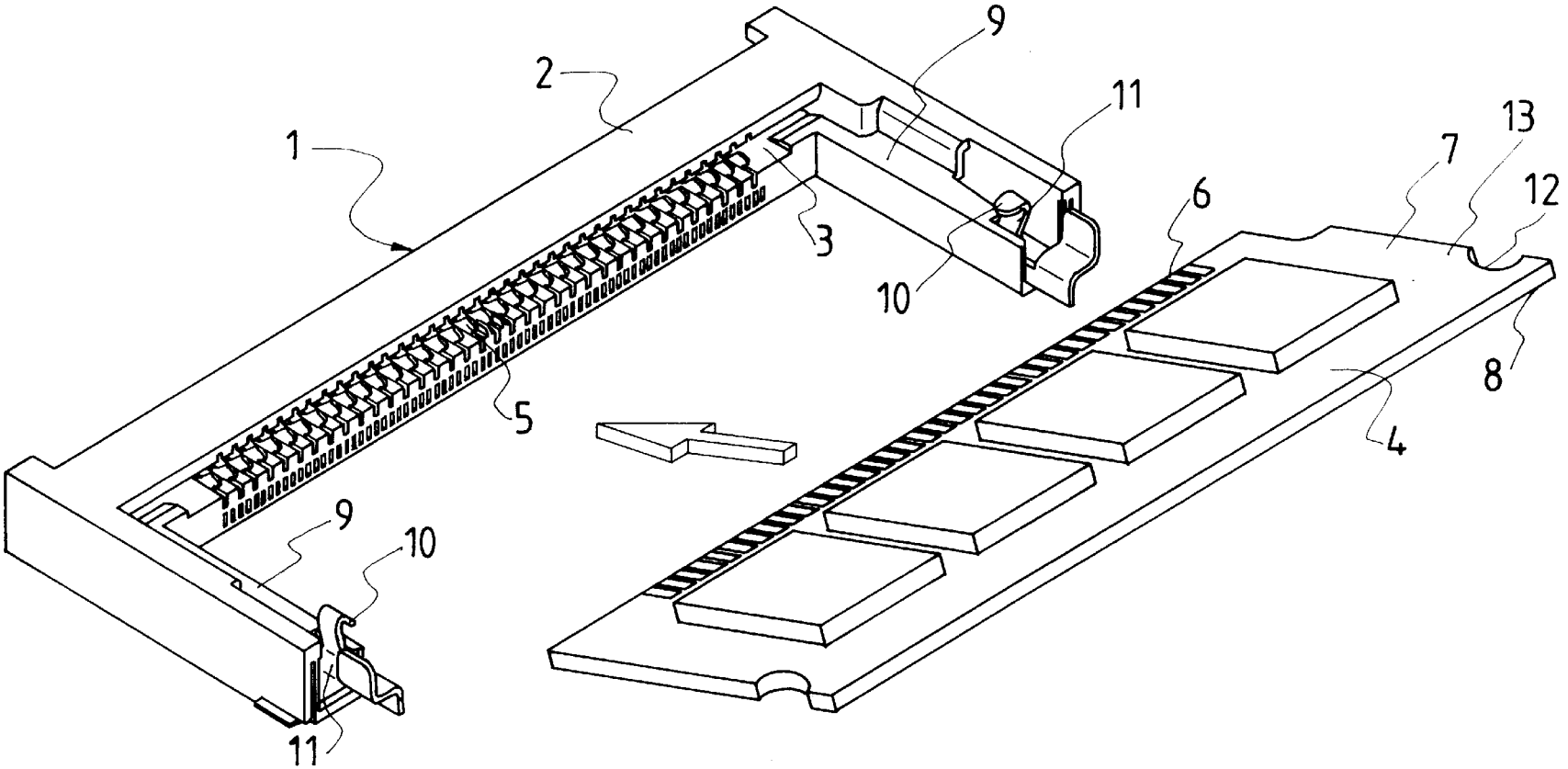
FIG, 1A

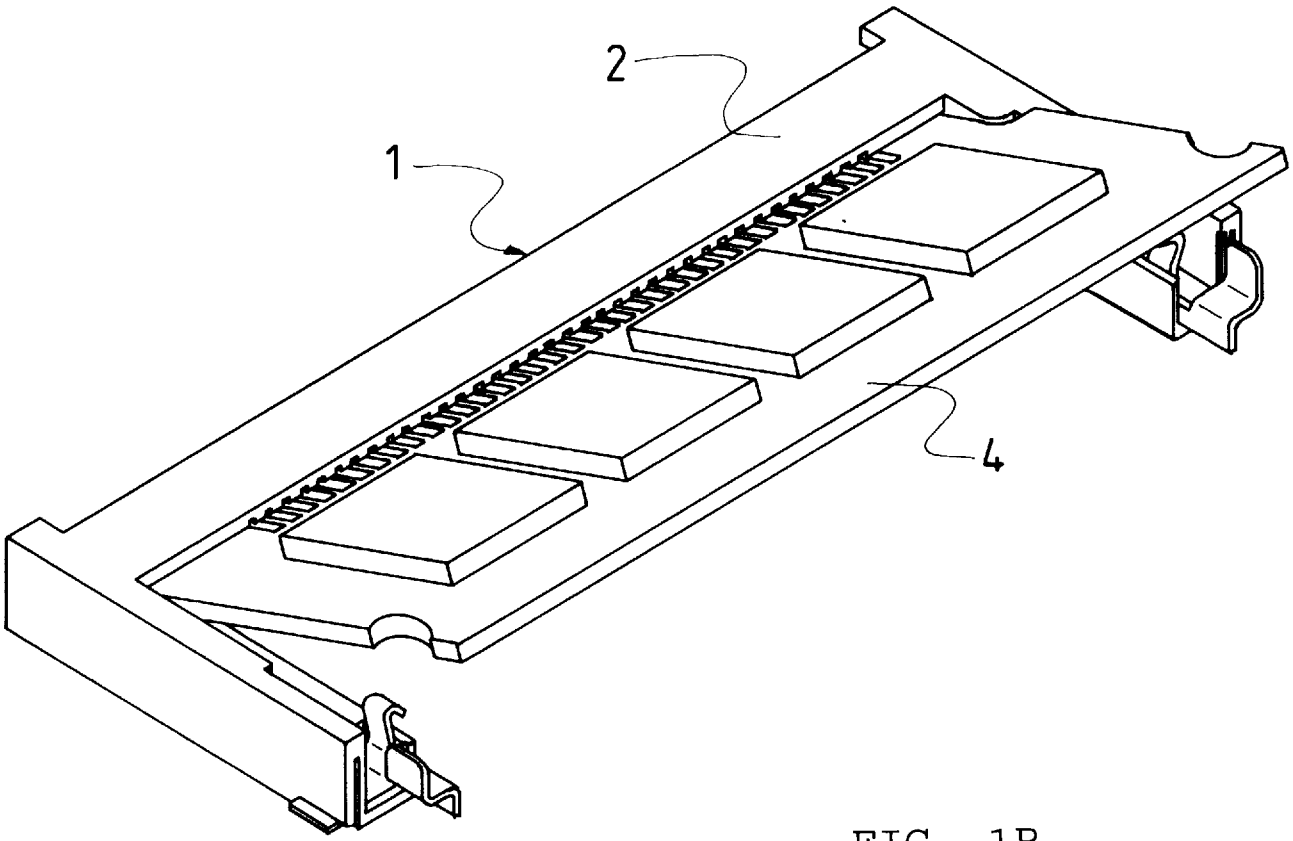
FIG, 1B

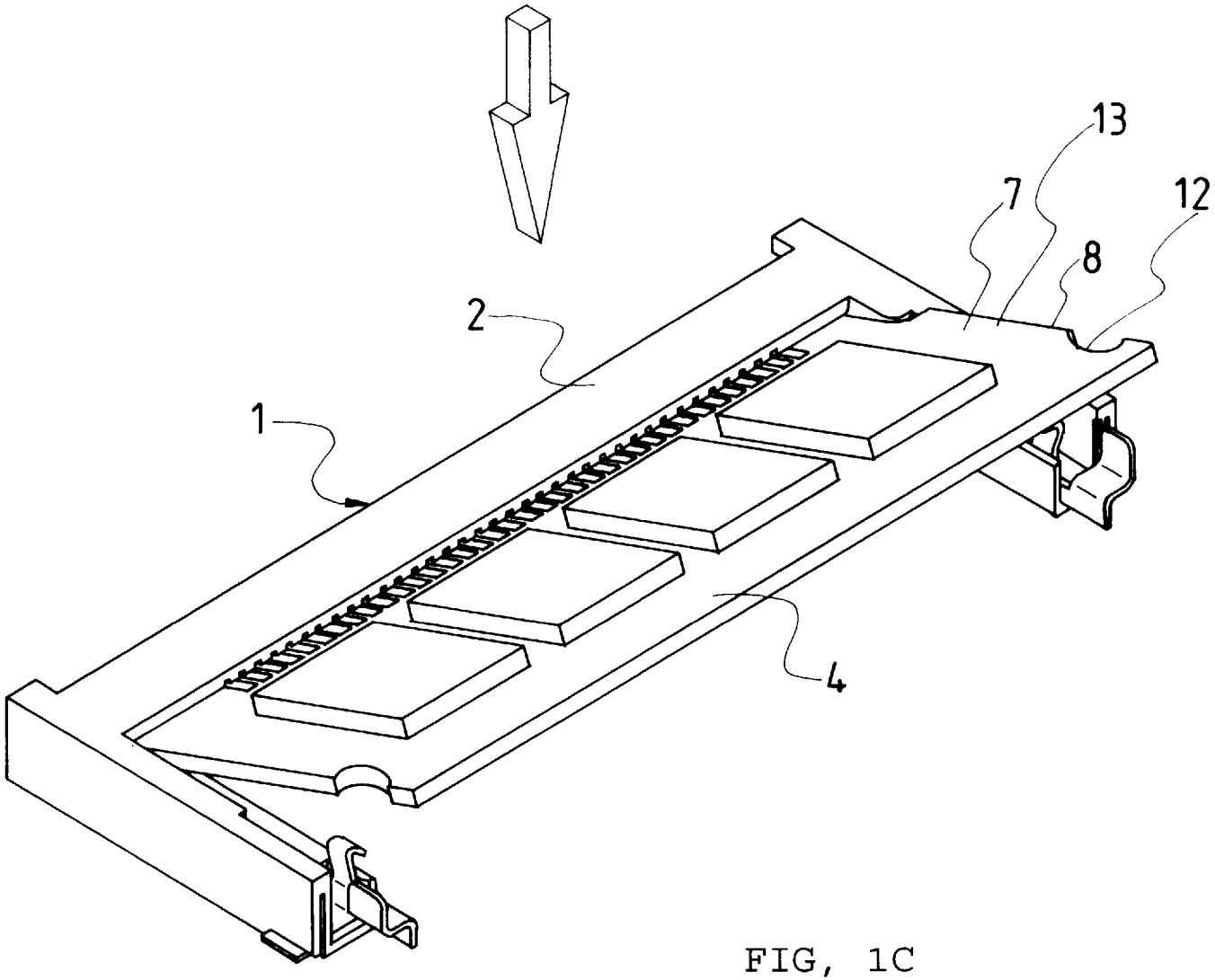
FIG, 1C

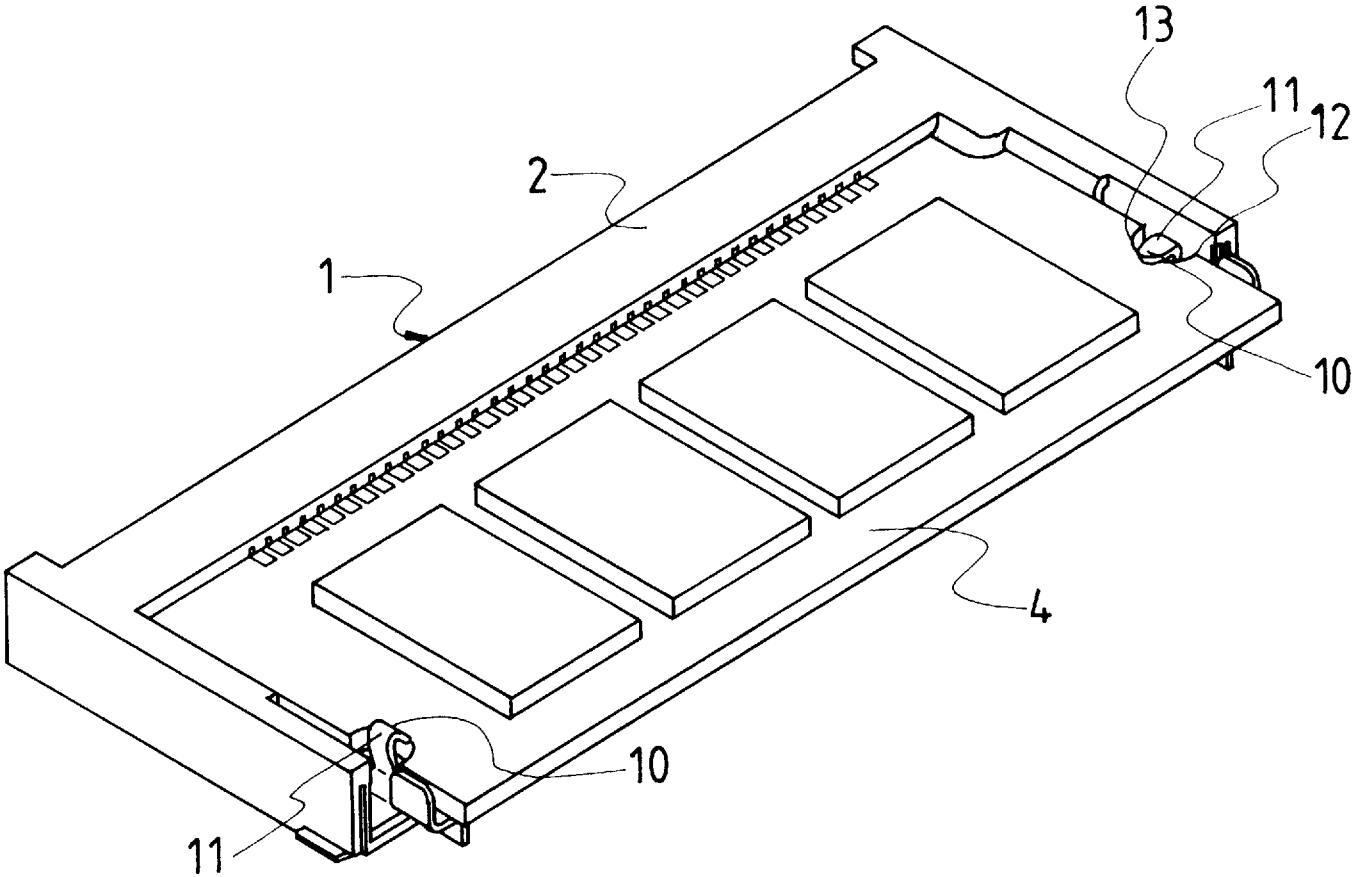
FIG, 1D

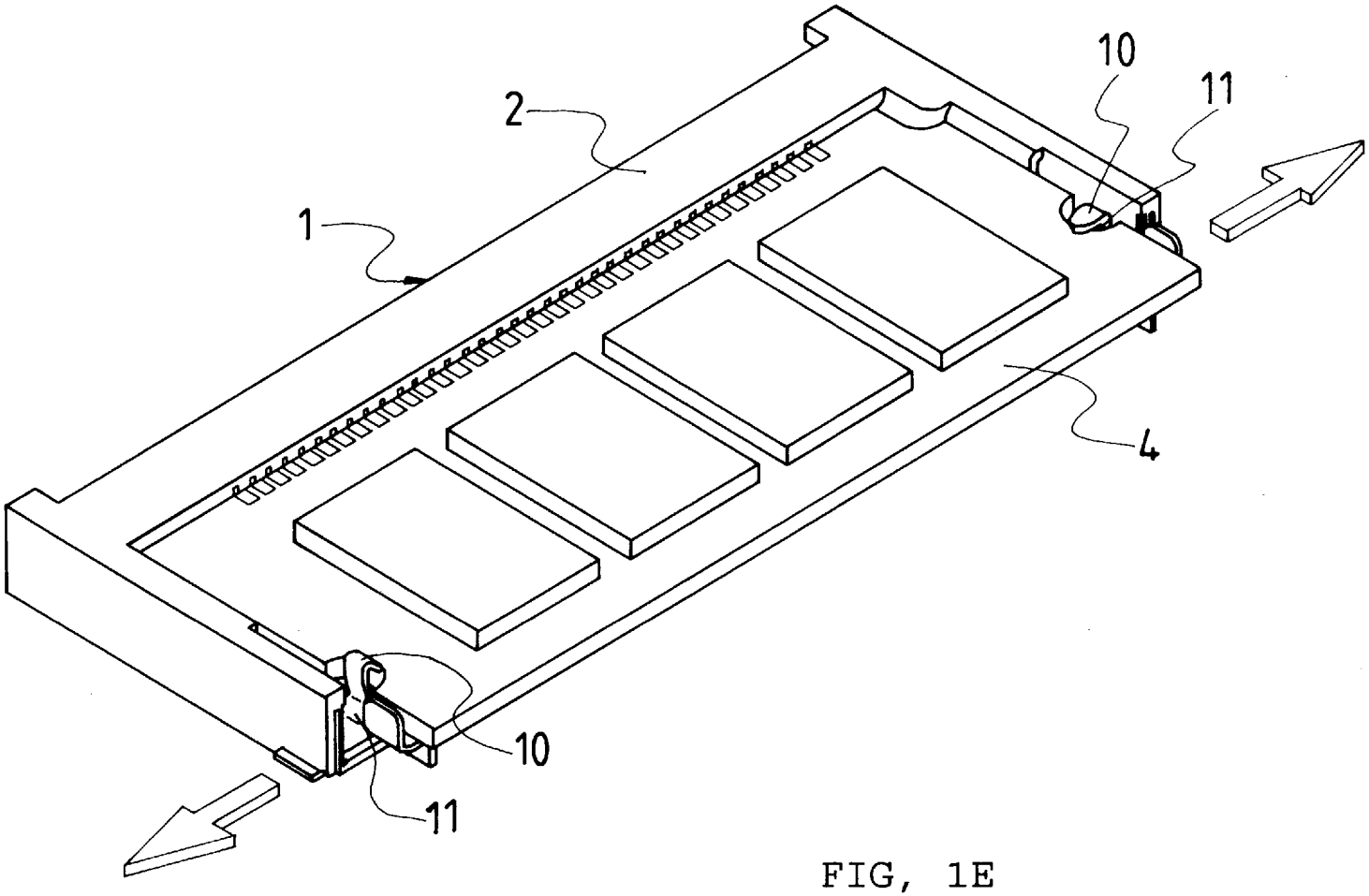
FIG, 1E

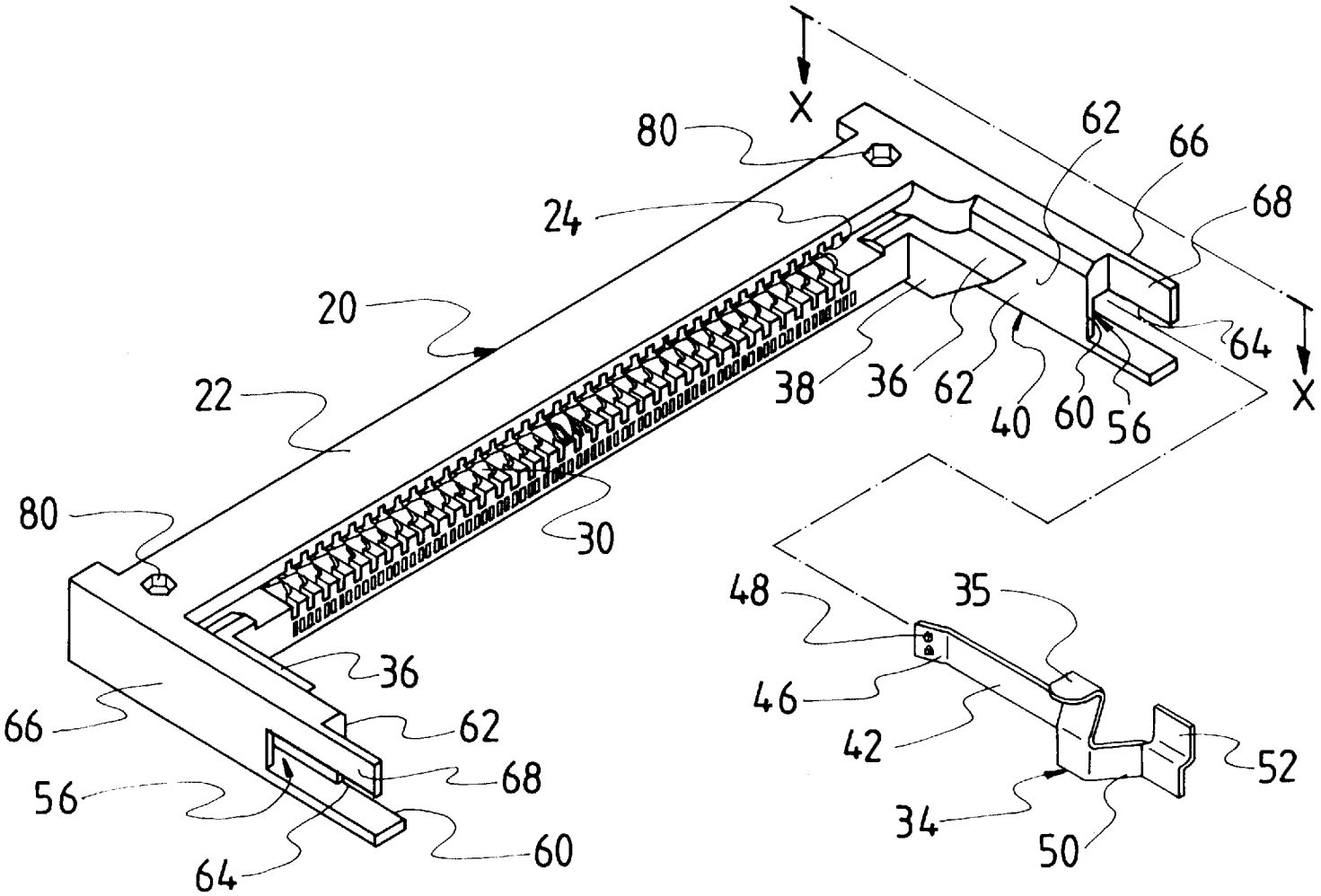
FIG, 2A

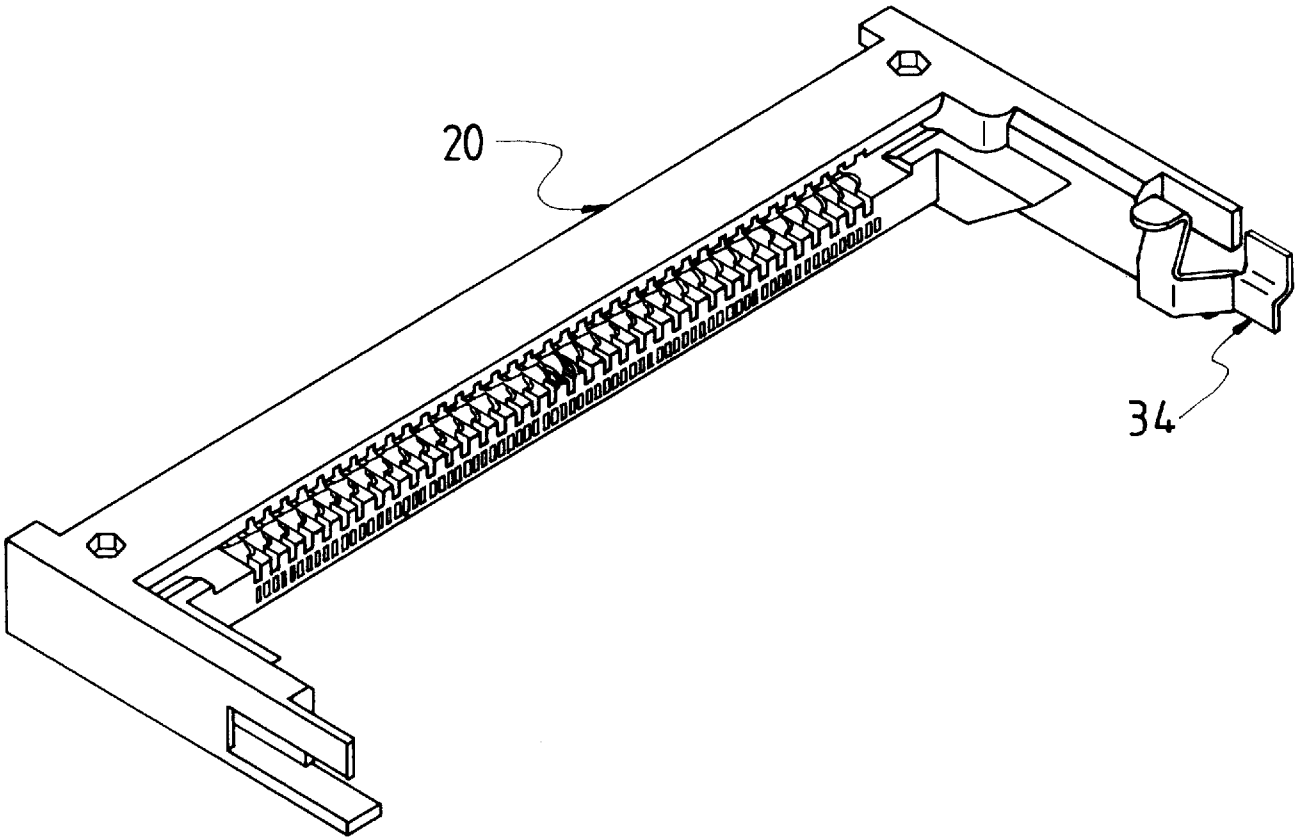
FIG, 2B

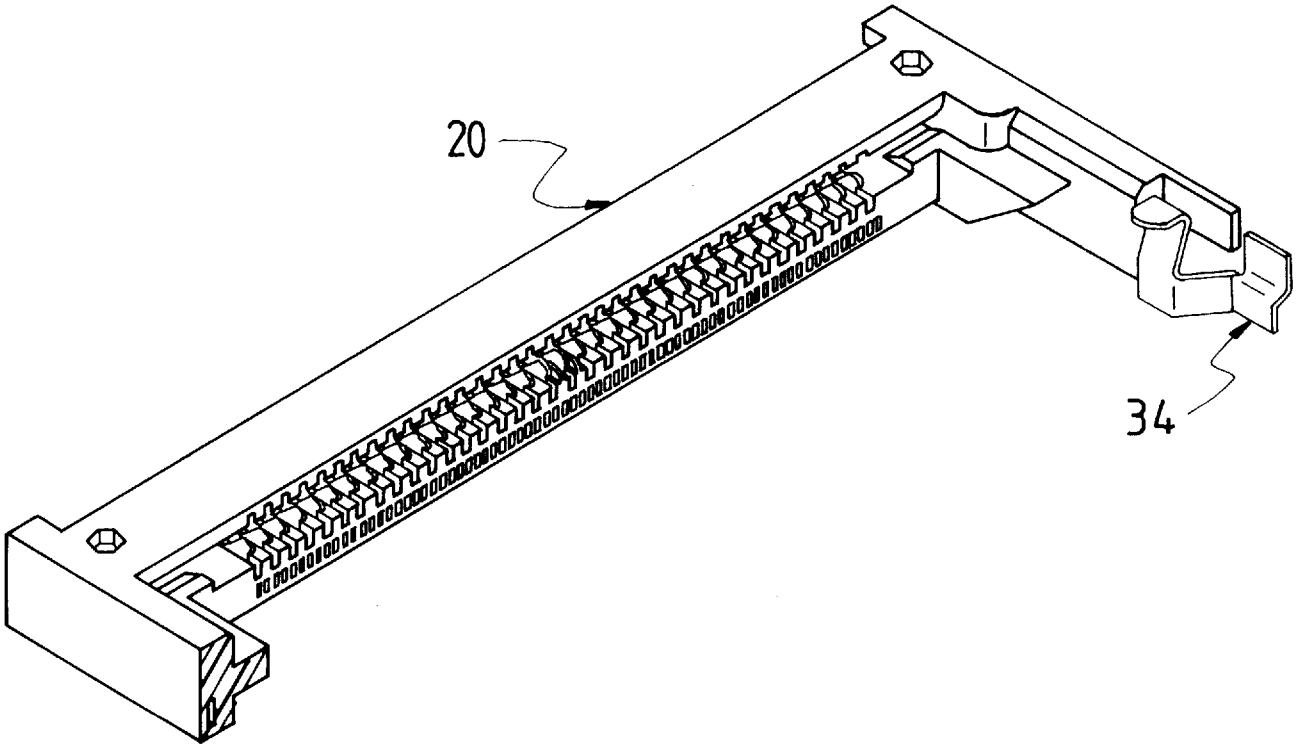
FIG, 2C

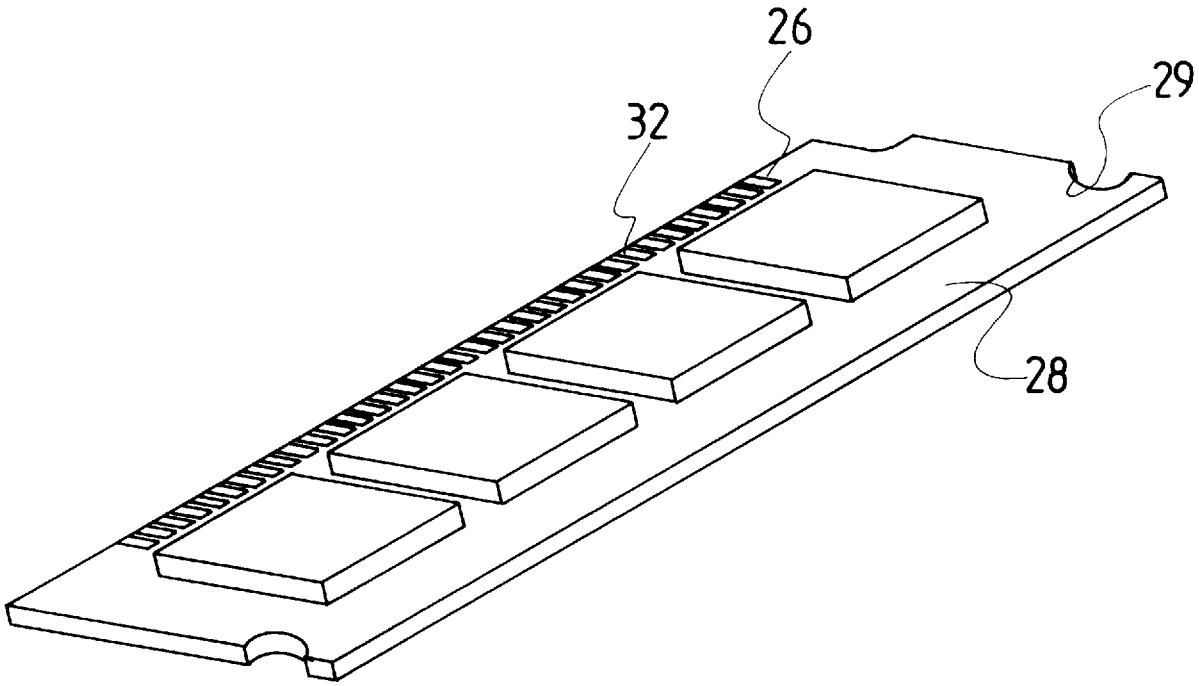
FIG, 2D

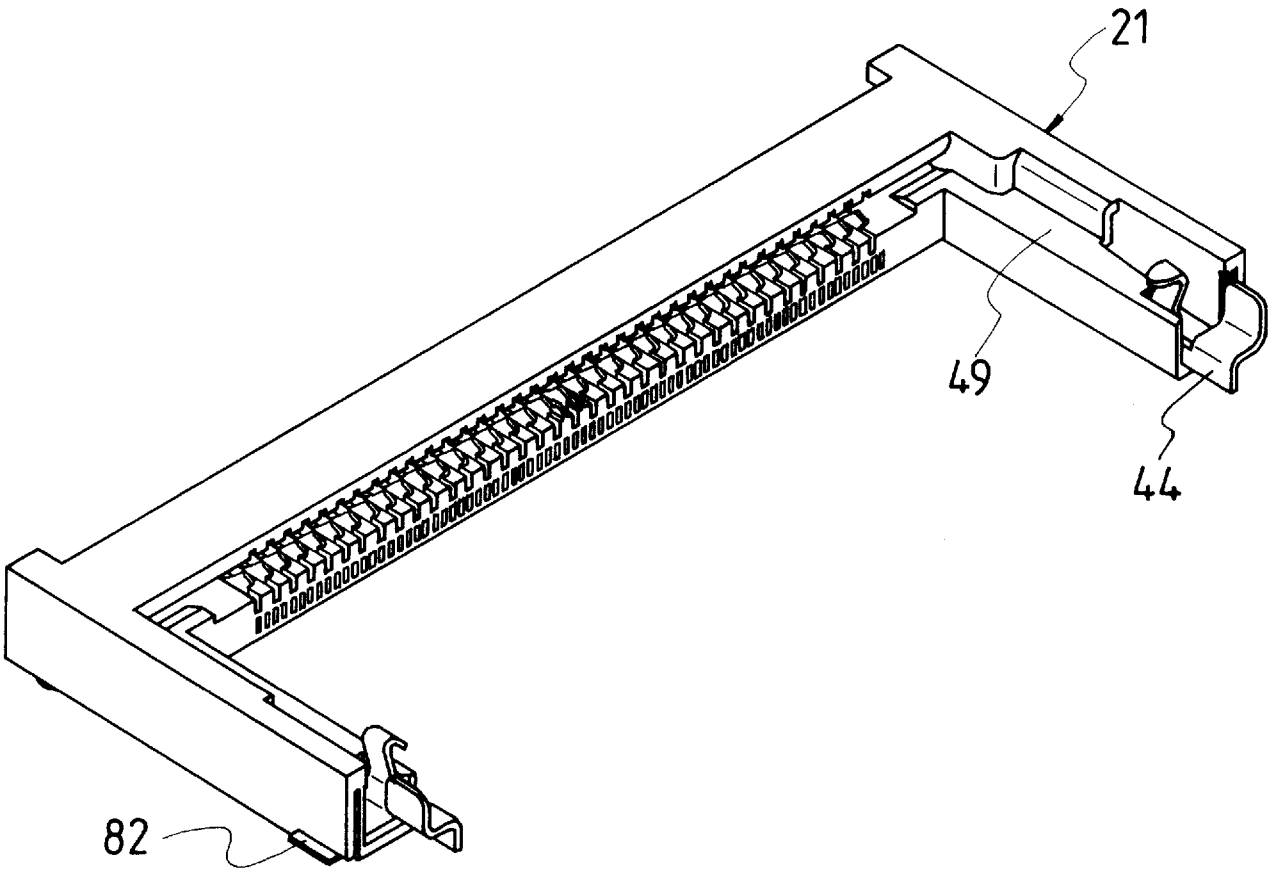
FIG, 2E

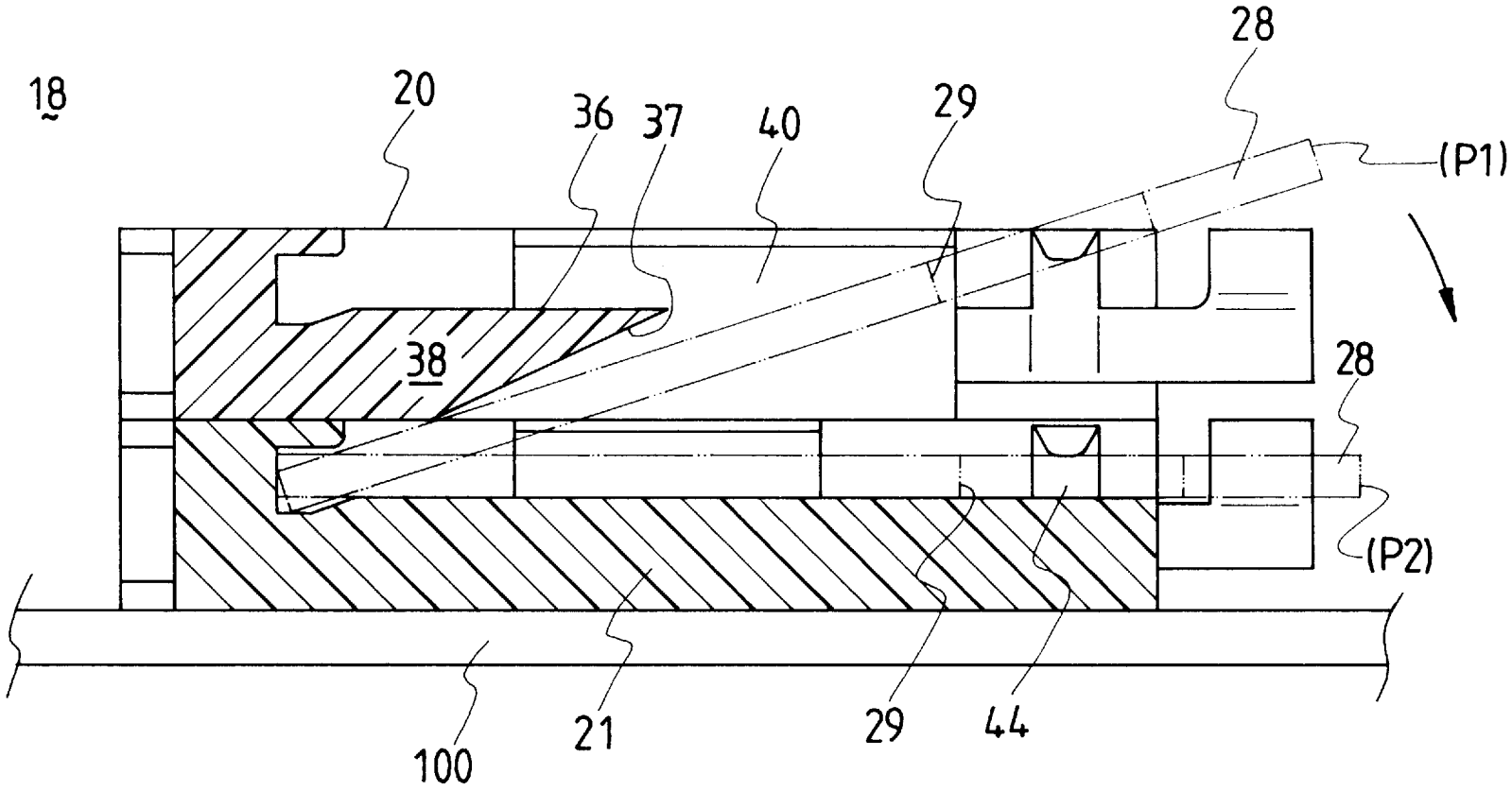
FIG, 3A

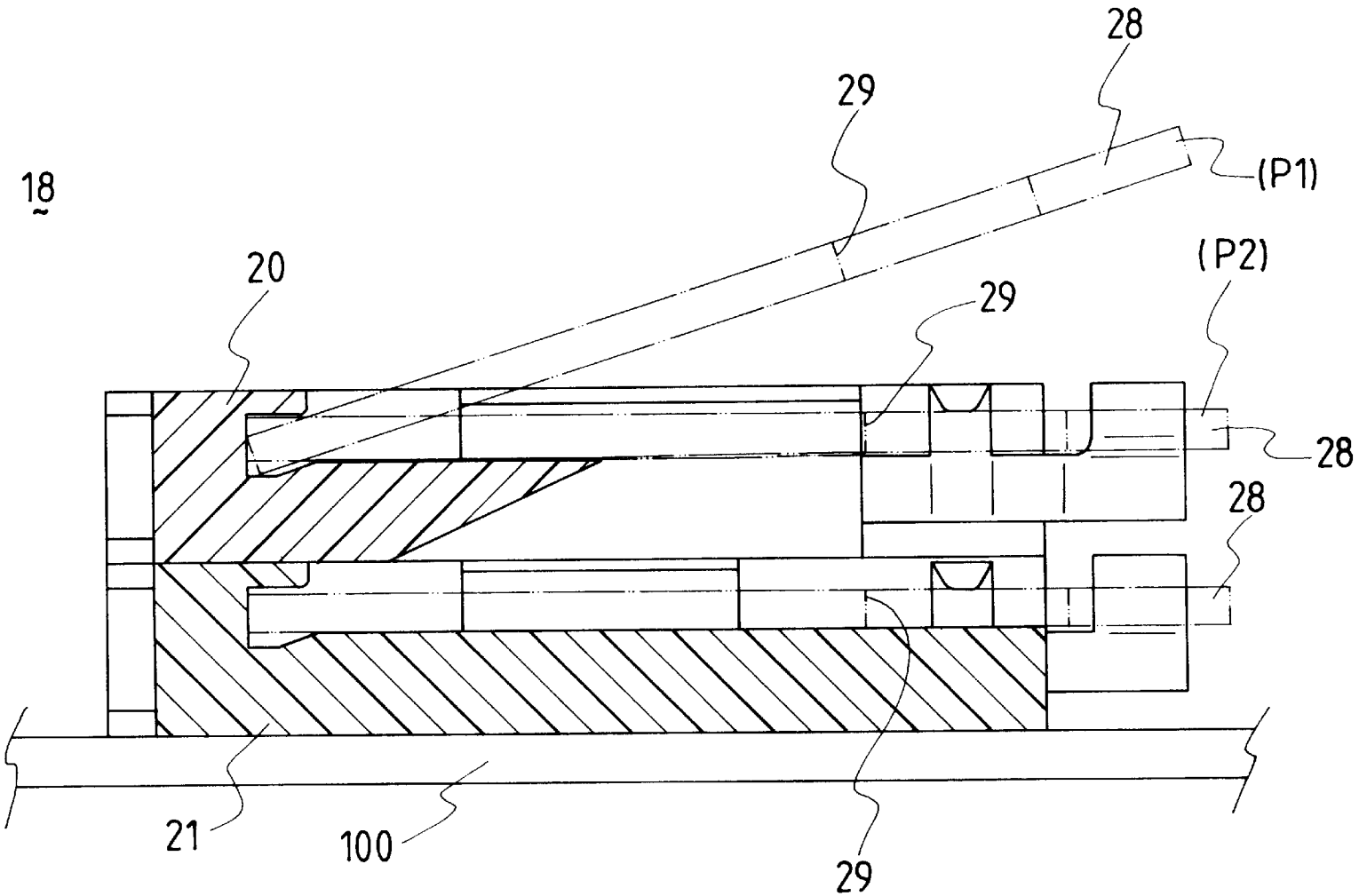
FIG, 3B

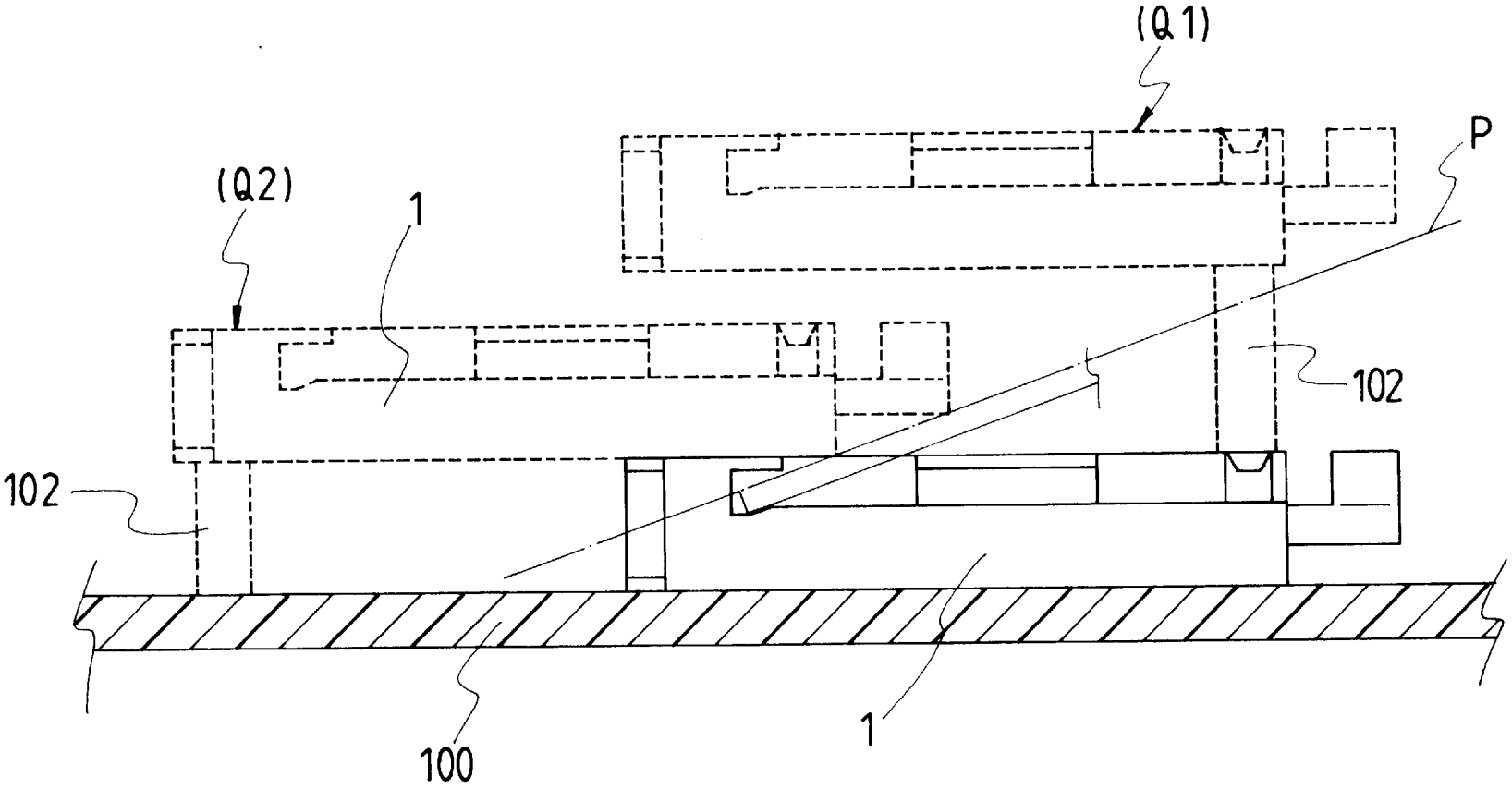
FIG, 4

STACKED HORIZONTAL SIMM CONNECTOR ASSEMBLY

BACKGROUND OF THE INVENTION

1. Field of The Invention

The invention relates to SIMM connectors, especially to horizontal type SIMM connectors of which two are stacked together as one assembly for respective receipt of two modules wherein the modules are respectively inserted into the corresponding connectors in a first position angular with regard to the main PC board on which the SIMM connector assembly is mounted, and the modules are retentively received in the corresponding connectors in a second position substantially parallel to the main PC board.

2. The Prior Art

SIMMs (Single In-Line Memory Module) are popularly used in the recent computer industry, so the SIMM socket connector is also commonly adopted as an interface between the SIMM and the mother board on which the SIMM socket connector is mounted. The conventional vertical type SIMM socket connector can be referred to U.S. Pat. Nos. 4,850,892, 4,986,765, 5,009,611, 5,112,242 and 5,286,217. To comply with (height) dimension reduction of the computer set, the slanted type SIMM socket connectors are introduced in the recent years which can efficiently minimize the vertical dimension of the module associated with the corresponding socket connector in the computer set. The slanted type SIMM socket connector can be referred to U.S. Pat. Nos. 5,013,257, 5,041,005, 5,116,237, 5,174,780 and 5,366,390.

To comply with the dimension of the notebook computer, in the past two or three years, a horizontal type SIMM socket connector called Mini SIMM socket is adopted in which the module can be received in the horizontal state and is substantially parallel to the mother board on which the socket connector is mounted. As understood, till now there is no U.S. patents issued regarding to Mini SIMM socket, but the basic structure of Mini SIMM socket can be referred to U.S. patent application Ser. No. 08/234,245 filed Apr. 28, 1994, now U.S. Pat. No. 5,514,002 issued on May 7, 1996.

For efficient use of the space inside the computer set, two Mini SIMM socket connectors are expected to be closely stacked together in a vertical direction for respective receipt of two modules, respectively. This application is very similar to that of the stacked type memory card connector assembly as shown in U.S. Pat. Nos. 5,149,276, 5,176,523, 5,290,174 (FIGS. 2–8) and 5,318,452 (FIGS. 15–17). The difference between applications of the Mini SIMM socket connector and memory card connector is that the latter has the card inserted and received in the same direction but the former has the module inserted at a first direction and successively rotated and retained in a second direction. Therefore, there is no problem to directly tightly stack the two simplex memory card connectors together in vertical alignment with each other for respectively receiving therein the corresponding two memory cards which are adapted to be inserted into and retained within the corresponding connectors in a same direction, but there is definitely a problem if two simplex Mini SIMM socket connectors are directly stacked together in a vertical direction for respectively receiving therein two modules which are adapted to be inserted into the socket connector in a first direction and successively rotated to be retained in a second direction.

FIGS. 1(A)–1(E) illustrate the reason why such a problem occurs. As shown in FIG. 1(A), the existing Mini SIMM socket connector 1 includes a housing 2 having a central slot 3 for receiving the bottom edge portion of a module 4 therein wherein a plurality of contacts 5 are disposed by two sides of the slot 3 for mechanical and electrical engagement with the pads 6 on the module 4. Referring to FIGS. 1(B)–1(E), the module 4 is inserted into the housing 2 of the socket connector 1 at an angle with regard to the housing 2 in a first (angular) position as shown in FIG. 1(B), and successively rotated to be releasably retained by the latches 11 in a second (horizontal) position as shown FIGS. 1 (C) & 1(D) wherein a undersurface 8 of the side portions 7 substantially abuts against the supporting surface 9 of the housing 2, and the hook 10 of the latches 11 engages the opposite surface 13 of the notch sections 12 of the module 4 such that the module 4 is generally and fixedly sandwiched between the hook 10 of the latch 11 and the supporting surface 9 in the connector 1.

It can be understood that when two Mini SIMM socket connector 1 are closely stacked together, (and the general structure of the stacked Mini SIMM socket connectors may be referred to FIGS. 3(A) & 3(B), it is impossible to have the corresponding module 4 inserted into the "lower" socket connector 1 because of occurring interference with the supporting surfaces 9 of the "upper" socket connector 1. This interference can be overcome by the development of the present invention illustrated hereinafter.

Therefore, an object of the invention is to provide a Mini SIMM connector assembly including two simplex Mini SIMM connectors stacked together, which can receive two SIMMs within its respective two simplex Mini SIMM connectors without any interference or inconvenience.

Another object of the invention is to provide an arrangement of two stacked simplex Mini SIMM socket connectors wherein the upper socket connector is designedly positioned with regard to the lower socket connector in a manner that will not induce any interference during insertion of the module of the lower socket connector.

SUMMARY OF THE INVENTION

According to an aspect of the invention, a Mini SIMM socket connector assembly is comprised of two stacked Mini SIMM socket connectors wherein each Mini SIMM socket connector includes a housing having a central slot with a plurality of contacts aside for receiving a module therein whereby the module can be inserted into the housing in a first position and successively rotated to be retained therein in a second position. The positioning arrangement of the upper connector with regard to the lower connector is designed to leave sufficient space thereabout for not resulting in any interference with the module of the lower connector during insertion of the module into the housing of the lower connector.

Yet, the housing of the upper connector may further include a cutout around its rear portion so that the module of the lower connector can be inserted into the corresponding lower connector housing without any interference even though the upper connector is closely seated on the lower connector in a vertical alignment.

BRIEF DESCRIPTION OF THE DRAWINGS

FIG. 1(A) is a perspective view of a conventional Mini SIMM socket connector and a module adapted to be inserted therein.

FIG. 1(B) is a perspective view of the connector of FIG. 1(A) with the inserted module in a first position.

FIG. 1(C) is a perspective view of the connector of FIG. 1(A) with the inserted module having an arrow to show the movement of the module for retention.

FIG. 1(D) is a perspective view of the connector of FIG. 1(A) with the inserted module fixedly retained therein by the corresponding latches.

FIG. 1(E) is a perspective view of the connector of 1(A) with the inserted module retained therein having an arrow to show the movement of the latch for releasing the module.

FIG. 2(A) is a perspective view of an upper Mini SIMM socket connector of the invention for use with a connector assembly having at least two Mini SIMM socket connector stacked together, with a latch removed therefrom to show the detailed structure of the latch.

FIG. 2(B) is a perspective view of the upper connector of FIG. 2(A) with a positioned latch.

FIG. 2(C) is a perspective view of the upper connector of FIG. 2(A) having portions cut away to show the recess behind the cavity for retaining the retention section of the latch therein.

FIG. 2(D) is a perspective view of a module for use with the upper connector of FIG. 2(A).

FIG. 2 (E) is a perspective view of a lower Mini SIMM connector for use with the connector assembly including two stacked Mini SIMM socket connector.

FIG. 3(A) is a cross-sectional view, taken along line X—X in FIG. 2(A) of a connector assembly comprised of the stacked upper connector of FIG. 2(A) and lower connector of FIG. 2(E) wherein such an assembly is mounted on a PC board, showing insertion of the module into the lower connector.

FIG. 3(B) is a cross-sectional view, taken along line X—X in FIG. 2(A) of a connector assembly comprised of the stacked upper connector of FIG. 2(A) and lower connector of FIG. 2(E) wherein such an assembly is mounted on a PC board, showing insertion of the module into the upper connector.

FIG. 4 is cross-sectional view of a second embodiment of a connector assembly comprised of two Mini SIMM socket connectors to illustrate the alternative positions the upper connector may located at.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is now directed to FIGS. 2(A)–2(E) and 3(A), 3(B) wherein an upper Mini SIMM socket connector 20 is adapted to be used in a Mini SIMM socket connector assembly 18 composed of two stacked Mini SIMM socket upper and lower connectors 20 and 21.

Similar to the lower connector 21 which is substantially similar to the conventional simplex Mini SIMM socket connector 1 mentioned in the prior art portion of this application, the upper connector 20 includes a housing 22 having a central slot 24 therein for reception of a bottom edge portion 26 of the module 28 which is substantially similar to the module 4 mentioned in the prior art portion of this application. A plurality of contacts 30 are positioned by two sides of the slot 24 for mechanical and electrical engagement with the corresponding pads 32 of the module 28.

Similar to the lower connector 21, the upper connector 20 has two latches 34 (only the right side one shown and the left side one being of a mirror image to the right side one) on two opposite ends for releasably latching the module 28 therein. The differences of the upper connector 20 with regard to the lower connector 21 include the dimension reduction of the supporting surfaces 49 of the lower conventional Mini SIMM socket connector 21, and the structural relationship of the latch 34 with regard to the module 28 which is adapted to be inserted into the lower or upper connector 21 or 20.

Therefore, the housing 22 includes, adjacent either end, a shortened supporting surface 36 in comparison with that of the lower connector 21 and a wedge section 38 is generally positioned underneath the support surface 36. In other words, in comparison with the lower connector 21, the upper connector housing 22 has a cut-out 40 inside a first side wall 62 and between its wedge section 38 and the hook 35 of the corresponding latch 34.

Additionally, different from that of the lower connector 21, the main body 42 of the latch 34 of the upper connector 20 is somewhat offset from the latch 44 of the lower connector 21. The basic structure of latch 44 of the lower (conventional) Mini SIMM socket connector can be referred to the copending application of Ser. No. 234,245 filed Apr. 28, 1994. Also, the generic latching function between the module and the latch of the housing can be referred to the same application for easy comprehension. The latch 34 of the upper connector 20 includes the strip-like main body 42 extending obliquely from the retention end 46 having the embossments 48 thereon for being retainably received within a recess 58 of the housing 22. An arch-like section 50 extends forwardly from the main body 42 and the hook 35 extends upward from the middle portion of the arch-like section 50 for engagement with the notch portion 29 of the module 28. Opposite to the main body 42, a lever 52 extends from the end of the arch-like section 50 for easy access from an exterior.

Corresponding to the latch 34, the housing 22 of the upper connector 20 includes a cavity 56 adjacent either end for receiving the corresponding latch 34. This cavity 56 allows the lateral movement of the deflected main body 42 of the latch 34 therein. A recess 58 (FIG. 2(C)) is positioned communicatively beside the cavity 56 for retainably receiving the retention end 46 of the latch 34 so that the latch 34 can be fixedly hold in the cavity 56. There is a first opening 60 positioned around the first side wall 62 of the housing 22 so that the arch-like section 50 (including the hook 35) of the latch 34 can extend out of the first side wall 62 of the housing 22 toward the central slot 24 for appropriate confrontation with the inserted module 28 of the upper connector 20. Oppositely, a second opening 64 is positioned on the second side wall 66 of the housing 22 for allowing the lateral movement of the main body 42 of the latch 34 during insertion or withdrawal of the module 28. It can be understood that the rear portion 68 of the second side wall 66 of the housing 22 can cooperate with the backside of the hook 35 for limiting the lateral movement of the deflected latch 34. In other words, the rear portion 68 of the second side wall 66 can be deemed as a stopper with regard to the deflection of the latch 34 and that can avoid the structural failure of the latch 34 due to the excessive lateral movement when releasing the module 28 from the connector 20.

Referring to FIGS. 3(A) and 3(B), when the modules 28 are ready to be inserted into the connector assembly 18 which is mounted on a PC board 100, the first module 28 is first inserted into the lower connector 21 from the top at an predetermined angle. Such a angle is generally in compliance with the wedge section 38 so that the first module 28 of the lower connector 21 can be inserted through the cut-out 40 of the upper connector 20 and along the undersurface 37 of the wedge section 38 into the lower connector 21 in a first position P1 wherein the bottom edge portion 26 of the module 28 is substantially received within the slot 24 of the lower connector 21. Successively, the first module 28 of the lower connector 21 is rotated from its first position P1 to the second position P2 with its bottom edge being as an imaginary rotation center. The notch portion 29 of the first module 28 can first laterally push away the latch 34 of the upper connector 20, due to resilience of the latch 34, by confrontation with the hook 35 of the latch 34 for its passing, and later when the whole thickness of the module 28 has passed the hook 35 of the latch 34, the latch 34 is sprung back to its original position. The position of such a restored latch 34 of the upper connector 20 will not prohibit the continuous downward movement of the first module 28 because the arch-like section 50 will not interfere with the first module 28 due to its compliance with the notch portion 29 of the module 28. Therefore, the first module 28 can be continuously moved downward to push away the latch 44 of the lower connector 21 and finally seated fixedly in the lower connector 21. After the first module 28 of the lower connector 21 has been loaded in the lower connector 21, the second module 28 of the upper connector 20 can be inserted into the slot 24 of the upper connector 20 in the first position P1 and rotated to be fixedly retained in the second position P2 (FIG. 3(B)). It can be understood that for the upper connector 20, the module 28 can be properly retained between the supporting surface 36 and the hook 35 of the latch 34 wherein the bottom edge portion 26 of the module 28 is also sandwiched between two rows of the contacts 30 of the connector 20, and a moment is actuated thereabout to generate an intention of reverse rotation of the module 28 for removal of the module 28 therein.

It can be noted that the lengthwise dimension of the module is substantially equal to or less than the distance defined between the opposite two first side walls 62, so that the portions of the housing 22 beside the first side wall 62, such as the second wall 66, will not obstruct insertion or rotation of the module with regard to the upper connector 20. In other words, in this embodiment the housing 22 of the upper connector 20 has no improper portions, between two opposite first side walls 62, forming obstruction to insertion of the module of the lower connector.

The feature of this embodiment of the invention is to provide some cut-out in the upper connector 20, which not only allows insertion of the module 28 of the lower connector 21 without interference, but also maintains the minimum sufficient supporting surface 36 for properly holding the module of the upper connector 20 therein. This feature is specially to meet the situation that such two Mini SIMM socket connector require to be tightly stacked together with a vertical alignment with each other.

The spirit of the invention generally concerns about an arrangement of an connector assembly composed of two stacked Mini SIMM socket connectors that allows the insertion of the module of the lower connector. As shown in FIGS. 3(A) and 3(B), the arrangement of the whole connector assembly to meet this requirement is to set the upper connector 20 having no substantial portions within the module lengthwise region and under the imaginary plane which generally extends along the same direction of the insertion angle of the module 28 from the central slot 24 of the lower connector 21. Therefore, in another embodiment of the invention which uses the conventional Mini SIMM socket connector 1 for both upper and lower connector, as shown in FIG. 4 along the imaginary plane P, position Q1 of the upper connector which is substantially aligned with lower connector in the vertical direction, and position Q2 of the upper connector which is substantially as close to the lower connector as possible are all feasible for implementation of this invention. Understandably, position Q1 saves the horizontal layout of the PC board 100, on which the connector assembly is mounted, but may waste dimension of the height; in contrast, position Q2 has advantages of the height dimension reduction, but may waste the space projected on the PC board 100. It can be appreciated that if other electrical components such as chips can still be mounted on the PC board 100 under the upper connector positioned in position Q2, position Q2 of this second embodiment may be another choice for the manufacturer when he does not intend to use another mold for fabricating the different upper connector for consideration of saving cost, and likes to use the identical conventional connectors for both the upper and lower connector design. It also can be noted that different from the first embodiment which has the upper connector substantially aligned with the lower connector in the vertical direction and naturally gains a better stable piling thereof, in this (second) embodiment, some standoffs 102 may be attached to the bottom of the upper connector for support of the upper connector atop the PC board or the lower connector.

It can be noted that in this second embodiment the position Q2 for the upper connector provides an offset with regard to the lower connector in a back-to-front direction, and this offset provides a benefit for offset of the levers of the latches for easy respective operation of latches of the upper and lower connectors.

It can be seen that in the first embodiment the top connector and the lower connector can further include screw holes 80 for cooperation with screws to fasten such a connector assembly on the PC board. Different from the lower connector 21, the upper connector 20 has no mounting pad 82 of the lower connector 21 which is adapted to be soldered on the PC board 100, because the upper connector 20 is not directly mounted on the PC board 100.

Additionally, the lever of the latch 34 of the upper connector 20 can be designedly arranged offset from that of the lower connector for easy respective operation of the latches of the upper and lower connectors. Understandably, the lower connector can also adopt the identical structure of the upper connector 20 as shown in FIG. 2(A) for implementation of the whole connector assembly of this invention. In other words, using an upper connector 20 to replace the lower connector 21 in a connector assembly 18, (i.e., using two upper connector stacked together), also allows receiving two modules therein, respectively.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A SIMM type connector assembly mounted on a PC board, comprising:

an upper connector and a lower connector stacked together and aligned with each other in a vertical direction;

said lower connector including a first housing defining a central slot with a plurality of contacts aside for mechanical and electrical engagement with a first module of which a bottom edge portion is received within said slot of the first housing, said first module being inserted into the first housing of the lower connector in a first position which is substantially angular with the PC board, and successively rotated to be retained in a second position which is substantially parallel to the PC board;

said upper connector including a second housing defining a central slot with a plurality of contacts aside for mechanical and electrical engagement with a second module of which a bottom edge portion is received within said slot of the second housing, said second module being inserted into the second housing of the upper connector in the first position which is substantially angular with the PC board, and successively rotated to be retained in the second position which is substantially parallel to the PC board; and the second housing of said upper connector further including a cut-out defining a sufficient space which allows insertion and rotation of the first module with regard to the connector assembly without any improper interference, wherein the second housing of said upper connector includes a shortened supporting surface, and a wedge section underneath said supporting surface.

2. The connector assembly as defined in claim 1, wherein said cut-out of the upper connector forms a space not only large enough to allow insertion and rotation of the first module without interference, but also small enough to leave a sufficient supporting surface for abutting against the second module when said second module is retained in the second position.

3. The connector assembly as defined in claim 1, wherein each connector has at least a latch adjacent one end thereof for retaining the corresponding module in the second position.

4. The connector assembly as defined in claim 3, wherein said latch of the upper connector includes a strip-like main body extending obliquely from a retention end, a arch-like section extending forwardly from the main body and a hook extending upward from a middle portion of the arch-like section for engagement with a notch portion of the second module, and a lever extending from one end of the arch-like section.

5. The connector assembly as defined in claim 5, wherein said second housing of the upper connector includes a cavity for receiving the latch, a first opening for allowing the arch-like section of the latch extending out of a first wall toward the central slot, and a second opening opposite to the first opening for allowing the lateral movement of the main body of the latch whereby a rear portion of a second wall can cooperate with the hook of the latch for restriction of lateral movement of the latch.

* * * * *